United States Patent [19]

Swift

[11] Patent Number: 4,687,240

[45] Date of Patent: Aug. 18, 1987

[54] SECURITY SEAL OF THE PADLOCK TYPE

[75] Inventor: Allan W. Swift, Denville, N.J.

[73] Assignee: E. J. Brooks Company, Newark, N.J.

[21] Appl. No.: 713,320

[22] Filed: Mar. 18, 1985

[51] Int. Cl.[4] ..... B65D 33/34

[52] U.S. Cl. ..... 292/320

[58] Field of Search ..... 292/320, 321, 326, 318, 292/322

[56] References Cited

U.S. PATENT DOCUMENTS

| | | | |
|---|---|---|---|
| 3,375,033 | 3/1968 | Moberg | 292/320 |
| 3,485,521 | 12/1969 | Moberg | 292/320 |
| 4,278,281 | 7/1981 | Moberg | 292/320 |
| 4,353,583 | 10/1982 | Moberg | 292/320 |

*Primary Examiner*—Richard E. Moore

*Attorney, Agent, or Firm*—Carella, Byrne, Bain & Gilfillan

[57] ABSTRACT

A seal of the type resembling a padlock and comprising a plastic housing having a pair of apertures for receiving a shackle of the type formed of a U-shaped piece of wire which reversely bent end portions, the extreme ends of which are intended to dig into the walls of the body apertures to prevent removal of the shackle. The body is provided with at least one longitudinal groove which is centrally located between the position of the shackle apertures, and the ends of the shackle are sharpened or beveled in a manner such that if an excessive tension is applied to a shackle leg, the sharpened end will penetrate the side wall of the groove, pass across the groove or just behind the bottom of the groove, and enter the opposite groove wall. The shackle, or a portion of raised plastic from the bottom of the groove is thereafter visible in the groove and gives visual evidence of tampering. In a preferred embodiment of the invention, the seal body is made of a pigmented plastic of a type which produces a white blush when deformed, so that any deformed plastic in the groove has a milky white appearance which is readily visible against the background of colored material. The fact that the sharpened end of the shackle is either disposed in the groove or enters the opposite wall of the groove insures that the sharpened end does not protrude from the seal body, which could be hazardous to persons handling the seal or the sealed article.

4 Claims, 8 Drawing Figures

SECURITY SEAL OF THE PADLOCK TYPE

BACKGROUND OF THE INVENTION

In U.S. Pat. Nos. 3,485,521 and 4,278,281 there are disclosed seals of the padlock type, in which the body is formed of a synthetic organic plastic, with a pair of apertures opening to one end of the body, and having a shackle formed of a piece of U-shaped wire having legs with reversely bent end portions. The end portions, when inserted into the body apertures, are intended to be locked therein by the fact that the end portion is maintained in a flexed condition so that the extreme end portion digs into a wall of the aperture and prevents removal. However it has been found that on occasion unauthorized persons have been able to work an end of the shackle out of its aperture without leaving evidence of tampering. It has been proposed that the ends of the shackle should be sharpened to increase their ability to dig into the aperture wall and prevent removal. However in either of the devices shown in the above mentioned patents, when excessive tension is applied to a leg of the shackle in an effort to pull it out of the housing, the end of the shackle will often pierce through the wall of the housing and protrude therefrom. Although this gives visual evidence of tampering, it has been found that the protruding end of the wire can be hazardous to personnel handling the assembled seals or the sealed article, and the provision of a sharpened end would considerably increase this hazard.

SUMMARY OF THE INVENTION

This invention provides a seal of the padlock type which comprises a plastic body having a pair of apertures for receiving a wire shackle which is generally U-shaped with legs having reversely bent ends which are dimensioned to be maintained in a flexed condition when inserted into the seal body apertures.

The extreme ends of the bent ends are provided with a sharp edge, such as by cutting the wire at an angle, so that said ends can readily pierce the housing when excessive tension is applied to the shackle legs. Means is provided for preventing the sharpened ends from protruding from the seal body after they have pierced the housing wall. For this purpose, in one embodiment of the invention, a groove is provided in at least one face of the seal body which extends between the apertures, and is so dimensioned and positioned that when sufficient tension is applied to one or both legs of the shackle in an attempt to pull the shackle out of the body, the end of the shackle will pierce the wall of the groove, and if the tension is great enough, the end of the shackle will cross the groove and pierce the other wall thereof. In either case the sharpened end of the shackle will not protrude from the seal body, yet visible evidence of tampering will appear in the groove. This evidence may, in some cases, be the wire itself crossing the groove, or in other cases may be a ridge of plastic extending across the bottom of the groove.

The depth of the groove or grooves in the body faces is such, in relation to the thickness of the body, that sufficient body material remains between the grooves that the body cannot be easily broken at the grooves, which would undesirable in that it could expose the sharpened end of the shackle.

The seal body is preferably made of pigmented plastic of a type, such as polypropylene, which produces a white blush when deformed. The ridge of plastic made by the end of the wire, in crossing the groove, has a milky white appearance that is readily visible against the background of the surrounding seal body.

DESCRIPTION OF THE ILLUSTRATED EMBODIMENT

Figure 1:
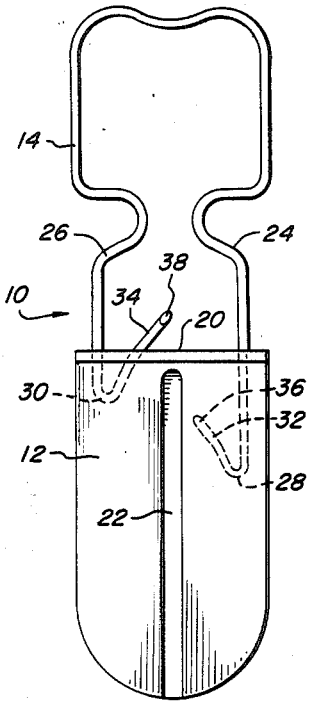
FIG. 1 is a plan view of a seal embodying the features of the invention, in condition for use.
Figure 2:
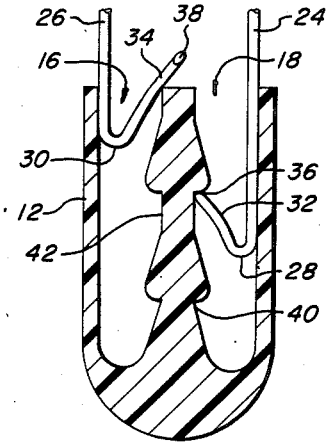
FIG. 2 is a view in section taken on line 2—2 of FIG. 1.

Referring to the drawing there is illustrated a seal 10 of the padlock type, comprising a plastic seal body 12 and a shackle 14 formed of spring wire.

In the illustrated embodiment of the invention the body 12 is provided with a pair of spaced apertures 16 and 18 which extend into the body from the top surface 20 thereof, and a pair of grooves 22, 24, disposed on opposite sides of the body, said grooves being disposed generally medially between the apertures.

The shackle 14 is generally U-shaped forming a long leg 24 and a short leg 26, the legs having bights 28 and 30 forming reversely bent end portions 32 and 34, the reversely bent end portions having extreme ends 36 and 38 respectively which are provided with sharpened ends 36 and 38 by being beveled in a manner and for a purpose to appear hereinafter.

The apertures 16 and 18 have a width substantially the same as the diameter of the wire of which the shackle 14 is made, and a length such that when the ends of the shackle are inserted into the apertures, the reversely bent end portions 32, 34, are maintained in a flexed condition so that the beveled ends 36, 38, bear against the inner walls 40 and 42 of apertures 16, 18, respectively.

The seal 10 is normally supplied to the user with the long leg 24 inserted in the aperture 16 and the bight 30 of the short leg projecting into the aperture 18, but not far enough that the end 38 of the short leg has entered the aperture, (See FIG. 1) so that the short leg may be easily removed from the aperture to enable the shackle to be passed through a staple 44 or the like of an article to be sealed.

Figure 3:
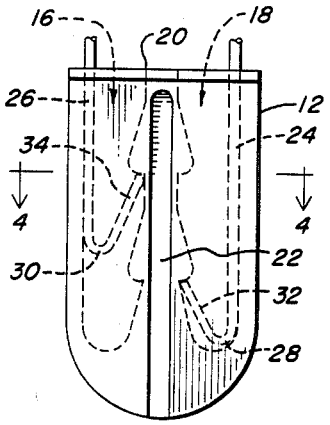
FIG. 3 is a plan view of the seal of FIG. 1 after assembly with an article to be sealed.
Figure 4:
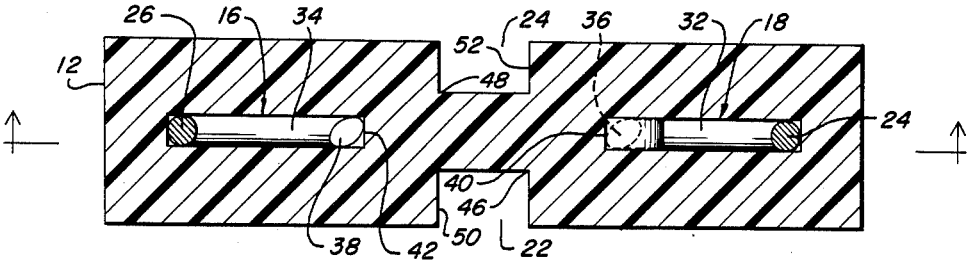
FIG. 4 is a view in section taken on line 4—4 of FIG. 3.

Thereafter the bight 30 may be reinserted into the aperture 18, and both legs pushed into the body so that both reversely bent ends are flexed by engagement with the end walls of the apertures. (See FIG. 3.)

In the illustrated embodiment the width of the apertures is about the same as the width of the strip 46 of material disposed between the grooves 20, 22, to provide a firm support for the pressure of the ends 36, 38, to prevent the pressure of the end of the leg against the plastic from breaking through the aperture wall under conditions of elevated temperature.

Figure 6:
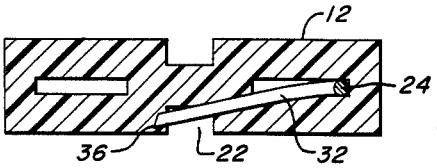
FIG. 6 is a view in section taken on line 6—6 of FIG. 5.
Figure 8:
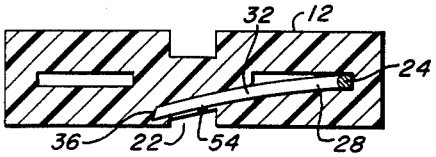
FIG. 8 is a view in section taken on line 8—8 of FIG. 7.

As illustrated in FIGS. 6 and 8, the ends 36, 38, are beveled at an angle and in a direction such that when tension is applied to the legs, the ends will pierce into the walls 40, 42 at the inner ends of the apertures, and the bevel on the ends will tend to force the ends outwardly so that they enter the groove at or about the corner of the aperture against which the sharp edge of the bevel is bearing. The angle of the bevel on the shackle ends tends to force the ends outwardly so that they enter the grooves at or about the corner 46, 48 thereof. If the tension applied to the legs is great enough, the ends 36, 38, will continue across the groove and enter the opposite wall 50, 52.

Figure 5:
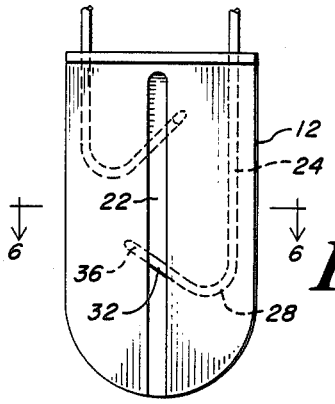
FIG. 5 is a plan view of the seal of FIG. 3 after excessive tension has been applied to the shackle, causing the end of a shackle leg to pass through the groove.
Figure 7:
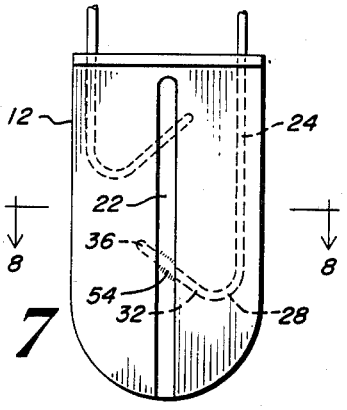
FIG. 7 is a plan view of another seal of the type shown in FIG. 3, in which excessive tension has been applied to the shackle, in which the end of the shackle has passed behind the bottom of the groove.

In some cases (see FIGS. 5 & 6) the end 36 or 38 will enter the groove at a position such that it will be completely exposed as it crosses the groove, providing visual evidence of tampering. In other cases (see FIGS. 7 & 8) the end 36 or 38 will pass just behind the bottom of the groove, raising a ridge 54 in the bottom of the groove. The deformation of the plastic caused by the forming of the ridge 54 causes the ridge to assume a milky white color, which is readily visible against the colored background of the rest of the seal body.

Whether, after such pulling, the end of the shackle will be exposed or whether it will form a ridge at the bottom of the groove depends on the exact angle of the bevel on the end of the shackle and the deformability of the plastic of which the body is formed. However, in either case, visual evidence of tampering is provided, and the sharp end of the shackle is embedded in the far wall of the groove, so that personnel handling the seal or the sealed article cannot be injured.

Also, in cases where, on an attempt to open the seal, a leg is not pulled with enough force to cause it to penetrate the far wall of the groove, the sharp end of the shackle is visible in the groove, or a partial ridge is visible, and the sharp end of the shackle is recessed in the groove, where it is out of the way of accidental contact by personnel. To maximize the visibility of the shackle or ridge in the groove, it is preferred that the width of the groove be at least as great as the depth, and that the sidewalls of the groove be substantially parallel.

Although in the illustrated embodiment of the invention, grooves are provided on both faces of the seal body, in some cases it may be necessary or desirable to provide a groove on only one face of the body, in which case the ends of the shackle could be beveled in such a manner that when the shackle is pulled, each shackle would pass into or across the single groove.

In any case, it is important that the depth of the grooves, in relation to the thickness of the body, should be such that sufficient body material remains between the grooves that the body cannot be readily manually broken at the grooves, which would be undesirable in that such breaking could expose the sharp end of the shackle.

It should also be understood that the grooves need not extend the entire length of the body, but could be provided in only the position at which the shackle end could appear. For convenience in molding, it is desirable that the grooves extend from this position to the bottom end of the housing.

Since certain other changes apparent to one skilled in the art may be made in the herein described embodiments of the invention without departing from the scope thereof, it is intended that all matter contained herein be interpreted in an illustrative and not a limiting sense.

I claim:

1. In a seal of the padlock type comprising a seal body having an aperture for receiving a reversely bent end portion of a shackle, said aperture and a said reversely bent end portion having dimensions such that the reversely bent end portion is maintained in a flexed condition when in the aperture so that the extreme end of the reversely bent end portion bears against a wall of the aperture, the improvement comprising a beveled surface formed on the extreme end of said reversely bent portion of the shackle to define a sharpened end, and a recess in the surface of the seal body associated with said aperture, the recess having a width at least as great as its depth, said sharpened end and said recess being configured and positioned in relation to each other that when excessive tension is applied to the shackle, said sharpened end penetrates the aperture wall and protrudes into the recess.

2. A seal as set out in claim 1 in which the thickness of the body at the recess is such that the strength thereof is sufficient to prevent the body from being readily broken manually at the recess.

3. A seal of the padlock type comprising a seal body formed of a pigmented plastic and having a pair of spaced generally parallel apertures opening to a top of the body for receiving the reversely bent ends of the legs of a U-shaped shackle, the improvement comprising a groove disposed in each face of said body, said grooves being generally opposite each other and medially disposed between the positions of the apertures, each groove having a width which is at least as great as its depth, the extreme end of the reversely bent portions of the shackle being so positioned and shaped, that excessive tension applied to a shackle leg causes said extreme end to pierce the wall of the aperture adjacent the groove and project into the groove.

4. A seal as set out in claim 3 in which each end of the shackle is beveled at an orientation such that tension applied to the shackle legs causes said beveled ends to tend to turn slightly outwardly in entering and passing through the groove.

* * * * *